US005950893A

United States Patent [19]

Heggeland

[11] Patent Number: 5,950,893

[45] Date of Patent: Sep. 14, 1999

[54] CONVERTIBLE STRAP AND HANDLE CONSTRUCTION FOR LUGGAGE

[75] Inventor: Bruce E. Heggeland, Barrington, Ill.

[73] Assignee: Bruce Heggeland, Inc., Barrington, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 08/574,722

[22] Filed: Dec. 19, 1995

[51] Int. Cl.[6] ..... A45F 3/14; A45C 13/26

[52] U.S. Cl. ..... 224/578; 224/258; 224/264; 150/107; 150/108; 190/115; 190/116; 294/141

[58] Field of Search ..... 224/578, 580, 224/257, 258, 264, 150; 150/107, 108, 110; 190/115, 116, 118; 294/141, 142

[56] References Cited

U.S. PATENT DOCUMENTS

| | | | |
|---|---|---|---|
| 119,293 | 9/1871 | Alexandre | 224/578 |
| 126,432 | 5/1872 | Alexandre | 190/116 |
| 2,392,926 | 1/1946 | Kelly | 190/115 |
| 3,275,336 | 9/1966 | Warner, Jr. | 190/115 |
| 5,119,910 | 6/1992 | Heggeland | 224/257 |
| 5,431,317 | 7/1995 | Kliot | 224/578 |

FOREIGN PATENT DOCUMENTS

| | | | |
|---|---|---|---|
| 3238276 | 4/1984 | Germany | 150/107 |

*Primary Examiner*—Linda J. Sholl
*Attorney, Agent, or Firm*—Banner & Witcoff, Ltd.

[57] ABSTRACT

A flexible tote strap for luggage and other portable articles includes an elongate strap which is attached at its opposite ends to the article to be supported by the strap. A buckle having first and second elements wherein each element includes a loop through which the strap is fitted and first and second connector rings through which the strap is looped coact to permit conversion of the strap from a single elongate support member for th e article to a three layer or five layer foreshortened support for the article. Permutations of the positioning of the ring elements and buckle elements as well as variable strap configurations are disclosed. The article or luggage is, thus, convertible between a shoulder strap and a handle type construction.

3 Claims, 13 Drawing Sheets

FIG.11
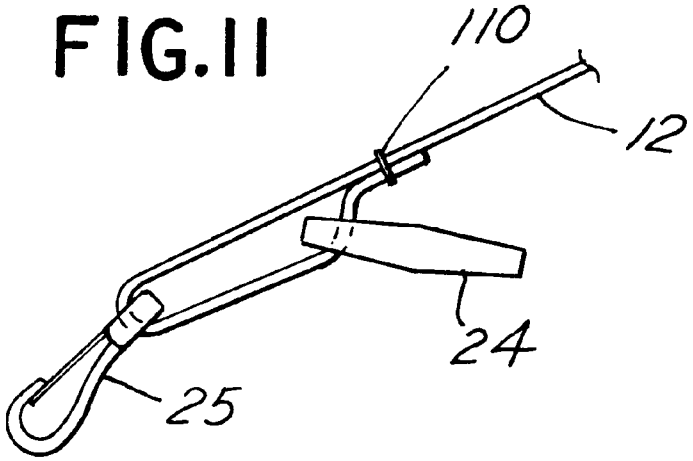
FIG.12
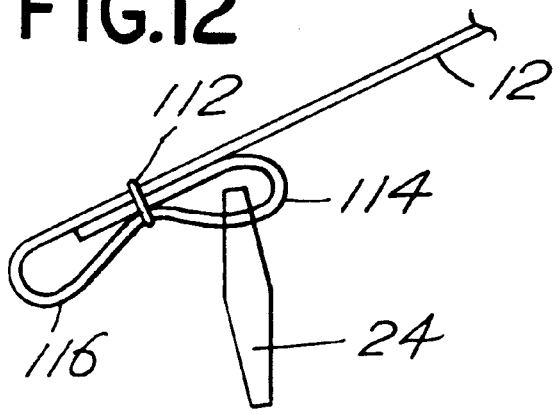
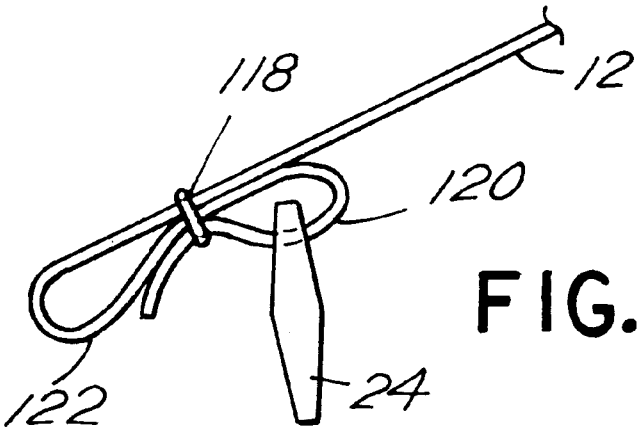
FIG.13

CONVERTIBLE STRAP AND HANDLE CONSTRUCTION FOR LUGGAGE

BACKGROUND OF THE INVENTION

This invention relates to a strap construction for luggage or other articles. The strap is convertible between a handle configuration and a shoulder strap configuration and the conversion is easily accomplished by sliding the strap through loop openings defined in buckle and ring elements which are incorporated in the strap construction.

In U.S. Pat. No. 5,119,910, incorporated here by reference, there is described a unique form of a quick change shoulder strap which may be converted into a hand held strap. The disclosure in that patent suggests that the strap may be attached at its opposite ends to an article and that intermediate the opposite ends there is included a buckle element which is looped through the strap as well as a ring element. These elements coact with one another in a manner which permits conversion of the strap from a shoulder length strap to a handle length strap wherein the shoulder strap is essentially folded in thirds when converted to the hand length configuration. The product disclosed in U.S. Pat. No. 5,119,910 has commercial application. Nonetheless, there remained the desire to provide additional alternative constructions; for example, a strap construction wherein the conversion may be effected to foreshorten the shoulder strap more than three times when changing from a shoulder strap to a handle strap, or a strap construction wherein the arrangement of the elements are improved, or a strap construction wherein the elements comprising the strap may be mounted in alternative ways which improve efficiency and attractiveness. These and other motivations inspired the development of the improvements set forth herein.

SUMMARY OF THE INVENTION

In a principal aspect, the present invention comprises a strap construction which is convertible between a short length and an elongate length. When the strap is in the elongate length, it is useful as a shoulder strap for luggage, for example; although, many articles may be supported by the strap construction of the invention, and the article supported thereby is not a limiting feature of the invention. That is, the strap may be utilized to effect holding of articles in place on a platform, rack or bed. Thus, the strap, itself may be configured from a substantially inelastic strap material or, alternatively, a flexible material such as a bungee cord. In each event, the strap is convertible between an elongate length and a shorter length which is some fraction of the elongate length. Typically in use as a luggage carrier, the elongate length constitutes a shoulder strap and the shortened length constitutes a support handle.

The disclosure of the present invention discloses that the elongate strap is attachable at its opposite ends to an item to be supported by the strap or retained by the strap. One or more buckles are associated with or used with the strap. A buckle includes a pair of first and second connectable buckle elements and is designed to connect portions or segments of a strap. Each buckle element typically includes a loop portion through which the strap is fitted. In one preferred embodiment or configuration, the strap also includes first and second connector rings through which the strap is looped or fitted. The first connector ring is positioned between the first buckle element, and the second buckle element. The first ring is also attached to the item to be supported at one end of the strap. The second connector ring through which the strap is looped is positioned between the second buckle element and the first buckle element. The second ring is also attached to the item at the opposite end of the strap. In this manner, the buckle elements may be coupled to one another to shorten the strap to the short length or decoupled to permit lengthening of the strap to the elongate length. When decoupling, the strap elements will be released from overlying one another and will slide through the loops of the various elements and rings, and when coupling the buckle elements, sections of the strap will be made to overlay one another so as to foreshorten the elongate length of the strap.

Pads and other ancillary elements may be incorporated in the strap. For example, a pad may be positioned on one side of the strap and may include elements which fit or fold over the strap. The strap may be bifurcated along a certain portion thereof. The strap may be modified or adjusted so as to be attachable adjacent one end thereof That is, the buckle elements may be positioned along or in association with one end of the strap or in association with a middle release of the strap. Various other combinations and permutations of the invention are set forth in the detailed description that follows.

Thus, it is an object of the invention to provide an improved convertible strap construction for support of luggage or retention of various items.

It is a further object of the invention to provide a convertible strap construction wherein the conversion from a short length to an elongate length may be effected so that the conversion from the short length to the long length may constitute various whole or fractional multiples of the short length.

It is a further object of the invention to provide a convertible strap construction wherein the elongate length of the strap is folded or caused to define multiple folds in order to foreshorten the strap.

Yet another object of the invention is to provide an improved inexpensive strap construction which may be utilized for many items and articles without significant conversion of the item or article to incorporate or accept the strap construction.

Another object is to provide a strap construction which incorporates a lock feature which enables enhanced security of the item associated with the strap.

A further object of the invention is to provide a strap construction wherein the strap is convertible between a handle support and an elongate strap support and wherein a center pad or handle is provided which remains centrally positioned when the construction is in either the handle or strap configuration.

A further object of the invention is to provide a convertible strap construction which may incorporate numerous types and styles of center handle and pad configurations and wherein a single handle on shoulder pad centered in the strap may be utilized.

These and other objects, advantages and features of the invention will be set forth in the detailed description which follows.

BRIEF DESCRIPTION OF THE DRAWING

In the detailed description which follows reference will be made to the drawing comprised of the following figures:

FIG. 11 is a side elevation of an end loop construction of a strap;

FIG. 12 is an alternative end loop construction of a strap;

FIG. 13 is yet another alternative end loop construction of a strap;

DETAILED DESCRIPTION OF THE PREFERRED EMBODIMENT

Figure 1:
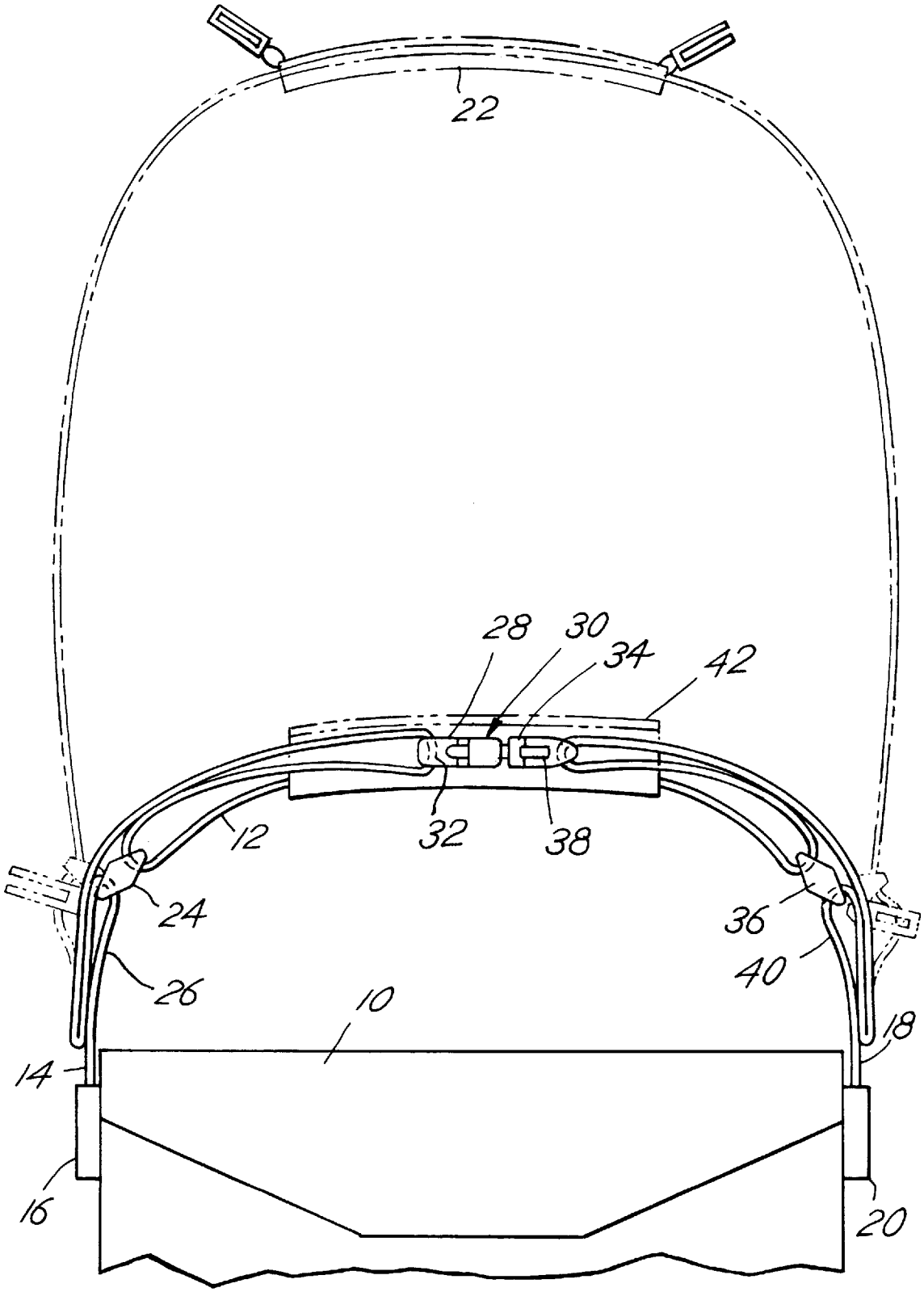
FIG. 1 is a side elevation of a first embodiment of the invention wherein the embodiment is depicted in the handle configuration and, in phantom, in the full elongate strap configuration.

Referring first to FIG. 1, there is depicted an item such as an item of luggage 10 which is supported by a strap 12. The item 10 constitutes an item which may be carried such as a handbag, luggage, a case, valise or the like. However, the construction of the strap may be utilized to tie down an element on a flat bed or platform, for example. That is, the strap 12 may be utilized as a tie-down device as well as a luggage strap. The strap 12 is typically a non-elastic member made from a flexible material such as fabric, leather, cable or almost any type of material which is elongate and flexible. An elastic strap material may also be utilized to enhance the utilization of the invention especially as a tie down device. The following description, however, will focus on the utilization of the invention as a strap for luggage or the like.

The strap 12 in this instance, therefore, is a elongate strip of material which is attached at its opposite ends. Thus, strap 12 has a first end 14 which is attached by attachment means 16 to one side of the item 10. In the described embodiment, the attachment means or mechanism 16 permanently attaches the end of the strap 12 to the item 10. It is possible to have a removable attachment mechanism 16 such as a clip, thereby permitting interchangability, for example, of strap 12 or substitution of strap 12 for item 10.

The opposite end of the strap 12 or the second end 18 is attached to the item 10 on the opposite side of item 10 by means of a second attachment means mechanism 20. Each end 14 and 18 thus may be permanently or removably attached to the item 10. The strap 12 is generally uniform in lateral dimension but can employ multiple widths or variable widths and in variable designs and patterns. A shoulder pad 22 may be affixed to the strap 12. The pad 22 may be affixed to the inside surface of the strap 12 to cushion the effect of holding the strap 12 on a shoulder. Alternatively, the pad 22 may be slidably mounted on strap 12 to permit adjustment along the length thereof as desired. Further, the pad 22 provides a gripping surface when the strap is in the shortened or handle configuration. Note, the pad 22 remains at the center of strap 12 in both the handle as well as the elongate condition as described below. Thus the pad 22 is preferably attached to strap 12 so that it will not slip.

In the embodiment shown, the first end of the strap 12; namely, first end 14, is extended through or looped through a first ring 24. The first ring 24 may be fabricated from metal, plastic or any other desired material. The first ring 24 defines a loop through which the strap 12 will slidably fit. The strap 12 thus defines a looped end 26 or loop 26 which fits through the first ring 24. Stitching or other means are utilized to define the loop 26. The strap 12, as show in FIG. 1, is further looped through a first buckle element 28 of a buckle 30. The buckle element 28 includes a through passage 32 through which the strap 12 fits and may freely move. The first buckle element 28 further includes a mechanism enabling it to be connectable with and connectable to a second buckle element 34 described in greater detail below.

The strap 12, subsequent to passing through the passage 32, is then looped through or passed again through the first ring 24. It then passes through a second ring 36 which is substantially identical to the first ring 24. The strap 12 next slidably fits through the second buckle element 34 and more particularly through a passage 38 substantially identical to passage 32. The strap 12 thus is free to freely move through the passage 38. The second buckle element 34 includes a latching mechanism cooperative with the latching elements of the first buckle element 28 so that the buckle elements 28 and 34 may be latched or hooked together or unlatched as desired.

Next the strap 12 passes through the ring element 36 defining a loop 40 substantially identical to the loop 26 formed by stitching the end of the strap 12 upon itself as depicted in the drawing. Thus, rings 24 and 36 are maintained, in the embodiment shown, substantially adjacent the first and second ends 14 and 18 of the strap 12 where those first and second ends 14 and 18 are attached to the item 10. FIG. 1 illustrates the arrangement of the described component parts when the strap 12 is in the shortened or handle type configuration. Note that, in this configuration, the pad 22 remains on the inside bottom of the assembly positioned at the center of the strap 12. In the embodiment shown, the pad 22 may include lateral flaps such as flap 42 which will overlay one another and be connectable by means of a Velcro fastener, for example.

Figure 2:
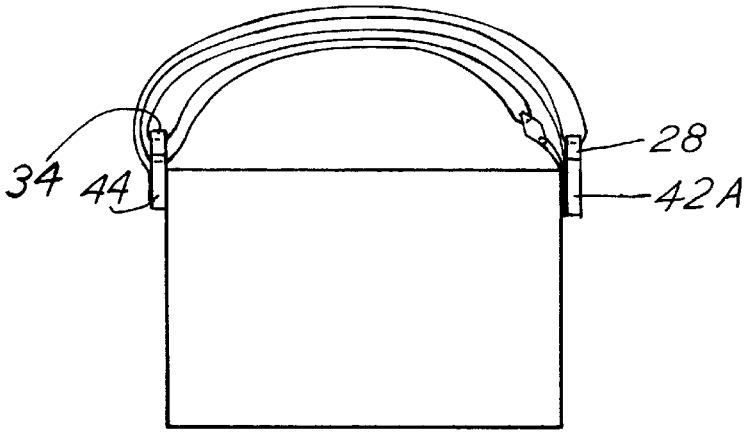
FIG. 2, is an isometric view of a second embodiment wherein the buckle elements are associated independently with separate end connectors to permit five layers of strap in the foreshortened condition.

Referring now to FIG. 2, there is depicted an alternative construction somewhat analogous to that depicted in FIG. 1.

In FIG. 2, however, the buckle elements 28 and 34 cooperate or attach respectively with additional separate side buckle elements 42 and 44 which are attached, respectively, to the ends 14 and 18 of the strap 12. The buckle elements 28 and 42, thus, may be connected one to the other as can the buckle elements 34 and 44 so as to foreshorten the strap 12 by an additional amount thereby creating five layers of strap 12 to form a handle. This is especially useful on a smaller item 10 where a long strap is required or desired, but the strap 12 must be shortened to act as a handle with the item 10.

Figure 3:
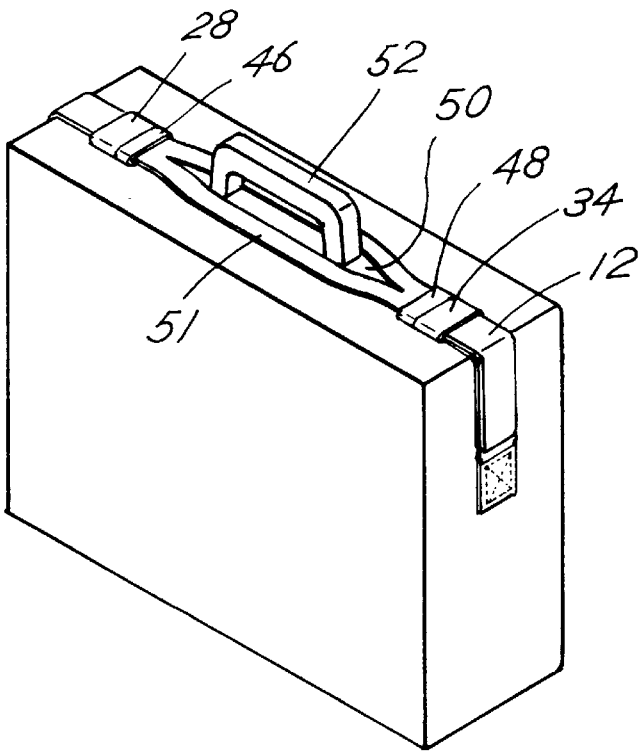
FIG. 3 is an isometric view of a third embodiment wherein the buckle members are attached to a handle member.
Figure 4:
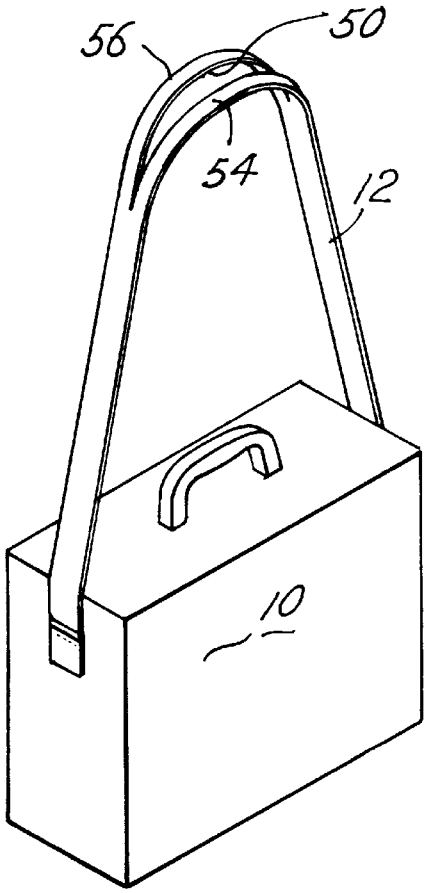
FIG. 4, is an isometric view of the construction of FIG. 3 wherein the strap has been released to the elongate position.
Figure 23:
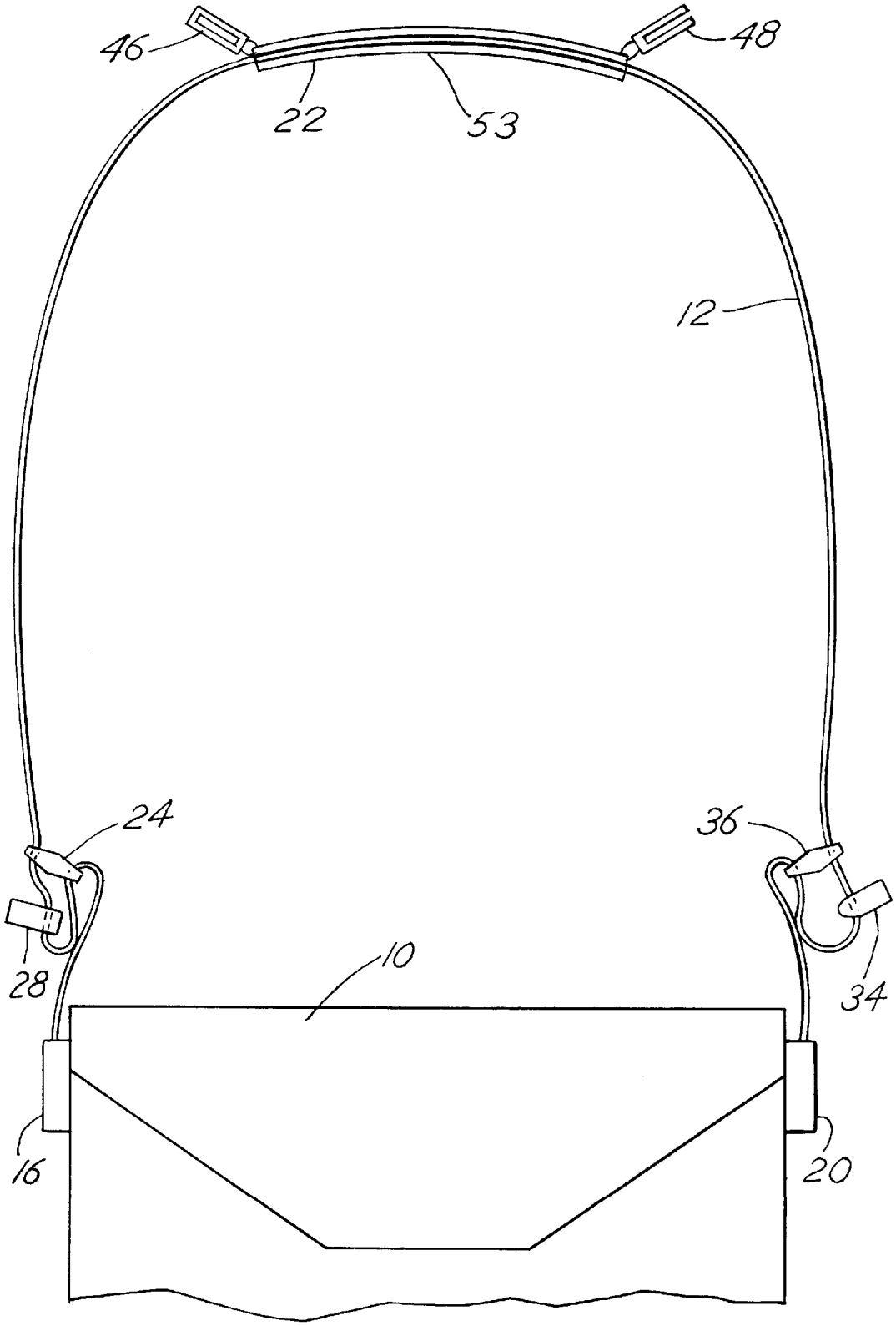
FIG. 23 is a side elevation of another embodiment of the invention.

Referring next to FIGS. 3,4 and 23, there is illustrated alternative embodiments wherein additional buckle elements 46 and 48 are provided at the opposite ends of a central, bifurcated section 51 (FIG. 3 and 4) or handle section 53 (FIG. 23) of strap 12. Thus, the buckle element 34 cooperates with element 48 attached to the junction of strap 12 and section 51 or section 53, as the case may be. The buckle element 28 cooperates with buckle element 46 attached to the opposite end of central section 51 or section 53 as the case may be. The portion or section 51 of the strap 12 in the embodiment of FIG. 3 is configured with a split or opening 50 therethrough so that it might fit over a handle 52 fixed to a briefcase or valise, for example. In FIG. 23, the section 53 is not split, but may include a pad 22 on the bottom side of section 53.

FIG. 4 illustrates the configuration of the assembly of FIG. 3 when the buckle elements 28 and 34 are released from elements 46 and 48 respectively. In the configuration of FIGS. 3 and 4, therefore, the portion 51 of the strap 12 defining the split sections 54 and 56 or split bands or runs 54 and 56 of the strap 12 permit further distribution of the weight of the item 10 on a shoulder. In addition, it permits utilization of the strap 12 in combination with a handle 52 associated with an item 10. Finally, the buckle elements 28, 46, 48 and 34 may include locking mechanisms associated therewith to further enhance the security of the case of item 10. For example, a small key and lock may be integrated in the buckle elements 28, 46, 48 and 34. Note that a lock may be utilized with all the embodiments shown in combination with buckle elements. As such the strap 12 may be wrapped around a chair or post or other item and locked in placed to thereby prevent theft.

Figure 5:
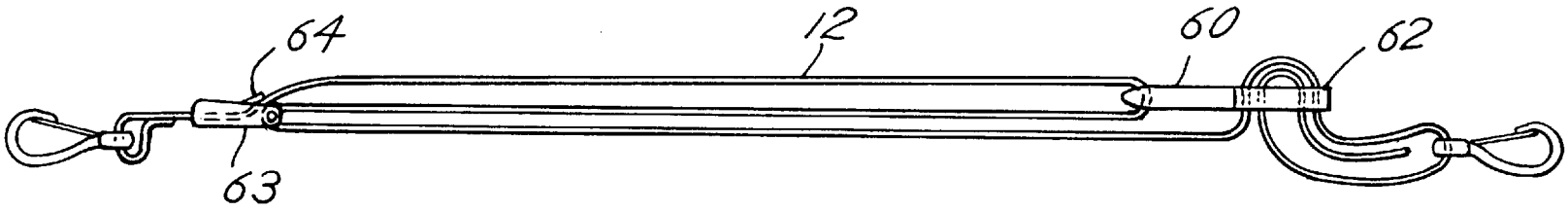
FIG. 5 is a side elevation of yet a further embodiment wherein the elongate strap length is adjustable.
Figure 6:
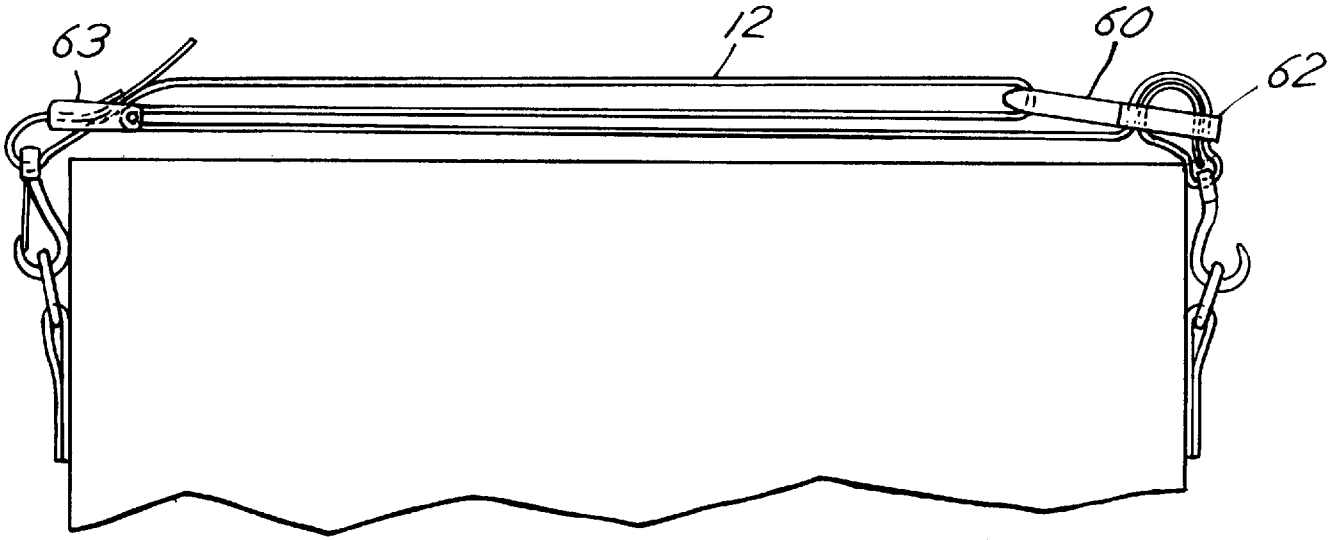
FIG. 6 is another variation of the embodiment of FIG. 5.

FIGS. 5 and 6 illustrate further variations of the construction. In the construction of FIGS. 5 and 6, first and second connectable buckle elements 60 and 62, of the type previously described, are utilized. However, the ring is a cam, ring mechanism. That is a ring 63 (which is substituted in place of the type of ring 24 previously described) includes a cam member 64 which may be utilized to restrict the movement of the strap 12 through the ring 63, thereby controlling the movement of the strap 12 and the elongate length of the strap 12.

Note, in FIG. 6, the end of strap 12 fitted through the ring 63 is not stitched. Thus the cam mechanism of ring 63 holds the end of strap 12 and also permits length adjustment of strap 12. Also note that the cam ring 63 in FIGS. 5 and 6 is specifically depicted as being substituted in a strap configuration as shown in my U.S. Pat. No. 5,119,910 (incorporated herewith by reference) for the ring member as depicted therein. However, either one or both rings 24, 36 of the strap assembly configuration of FIG. 1 above may include a cam mechanism like that described to provide for total length adjustment of the strap 12.

In review, the strap 12 passes freely through one portion of the ring element 63. However, a lever with a cam member 64 coacts with the end of the strap 12 to adjust the amount of movement of the ring 63 thereby permitting infinite adjustment of the strap between the handle configuration and the elongate configuration.

Figure 7:
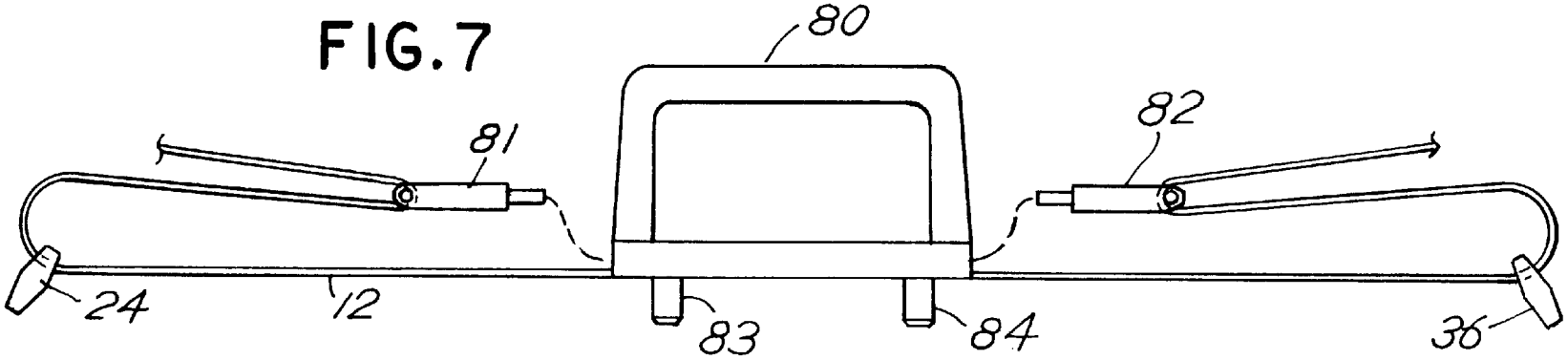
FIG. 7 is a partial side elevation of a variation of the embodiment of FIG. 3.
Figure 8:
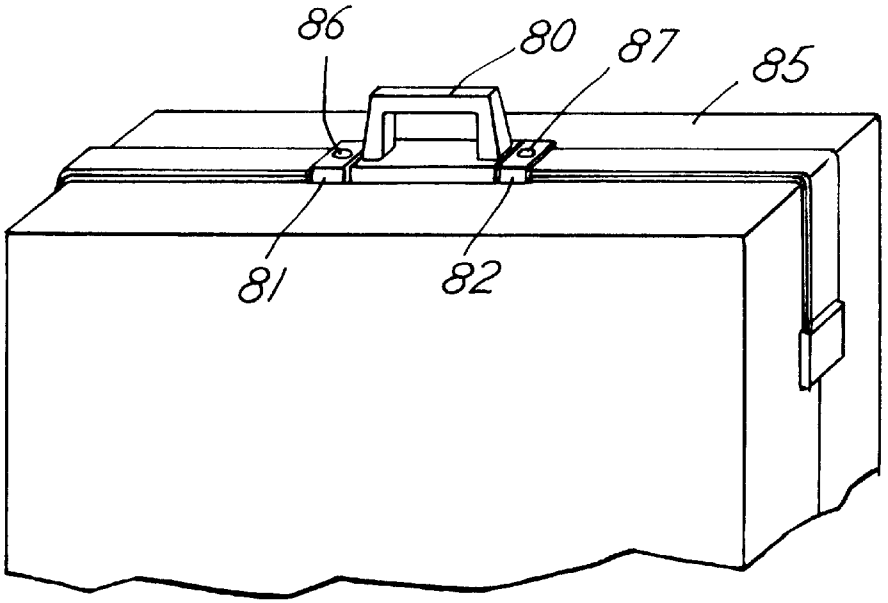
FIG. 8 is an isometric view of the configuration of FIG. 7.

FIGS. 7 and 8 illustrate further configurations of the invention. Thus, in FIG. 7, a molded handle 80 is incorporated at the midpoint of strap 12. The rings 24 and 36 are utilized as previously described. The handle 80 is, however, the alternate feature of the embodiment of FIGS. 7 and 8. The handle 80 may be a molded plastic handle for example. Handle 80 coacts with buckle elements 81 and 82 which engage into the molded handle 80 on opposite sides thereof to effect the foreshortening of the strap 12. The molded handle 80 may also include prongs, for example, prongs 83 and 84, which are aligned with openings (not shown) in the valise or case so that the handle 80, as shown in FIG. 8, may be appropriately positioned and engaged with the case or valise 85. In this manner, the configurations of the present invention have a professional appearance when in the handle configuration. When the buckle elements 81 and 82 are released, the strap becomes elongated. The handle 80 may be carried on the shoulder and in order to overcome the effect of the prongs 83 and 84, the handle 80 may be rotated to one side or the prongs 83 and 84 may be case members going into holes in the molded handle. Alternatively, padding may be incorporated. Various other means and mechanisms may be utilized in order to effect the comfort and utility of handle 80 when in the shoulder strap configuration. It should be noted, as depicted in FIG. 8, that the buckle elements 81 and 82 may include locks 86 and 87 to thereby enhance the security of the configuration depicted in FIGS. 7 and 8.

Figure 9:
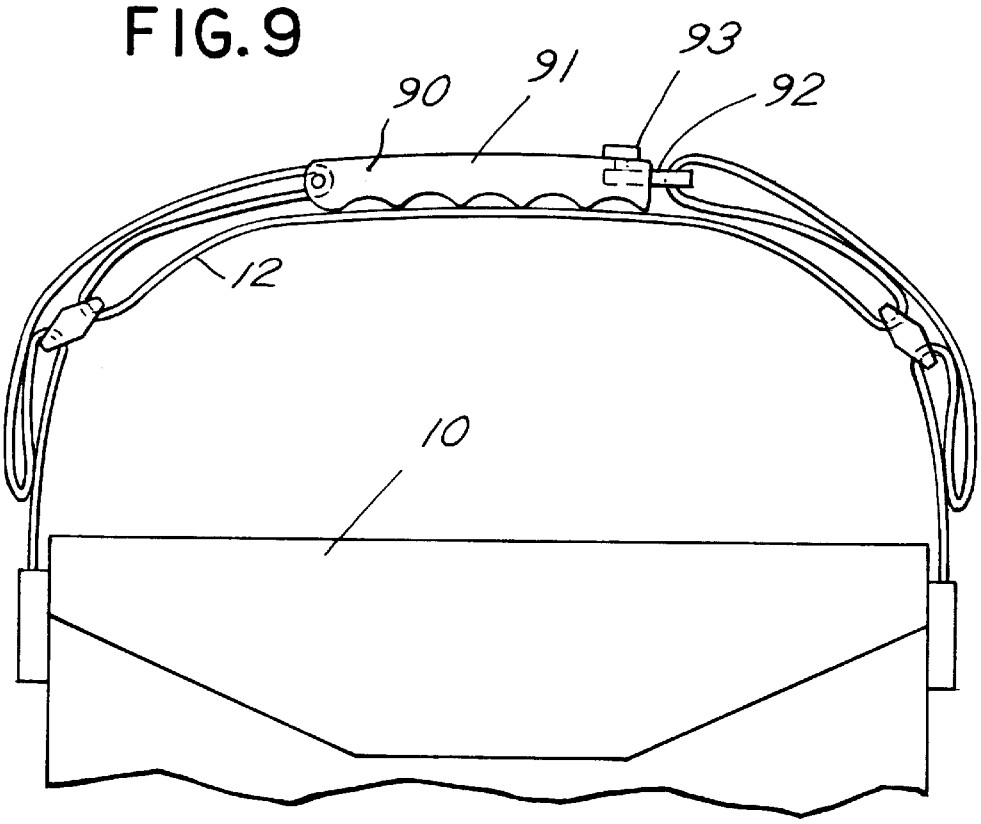
FIG. 9 is a side elevation of another alternative construction similar to FIG. 1.

Referring next FIG. 9 is depicted a further alternative construction. In this construction, the handle 90 comprises a molded plastic handle 90 which is molded for easy gripping by manual means. The handle 90 in this configuration defines a first buckle element 91 and a second buckle element 92. The elements 91 and 92 are thus analogous to the elements 32 and 34 described with respect to the construction of FIG. 1. The second element 92 coacts with the first element 91 and may be latched or locked thereto. A lock and key mechanism 93 may also be utilized.

Figure 10:
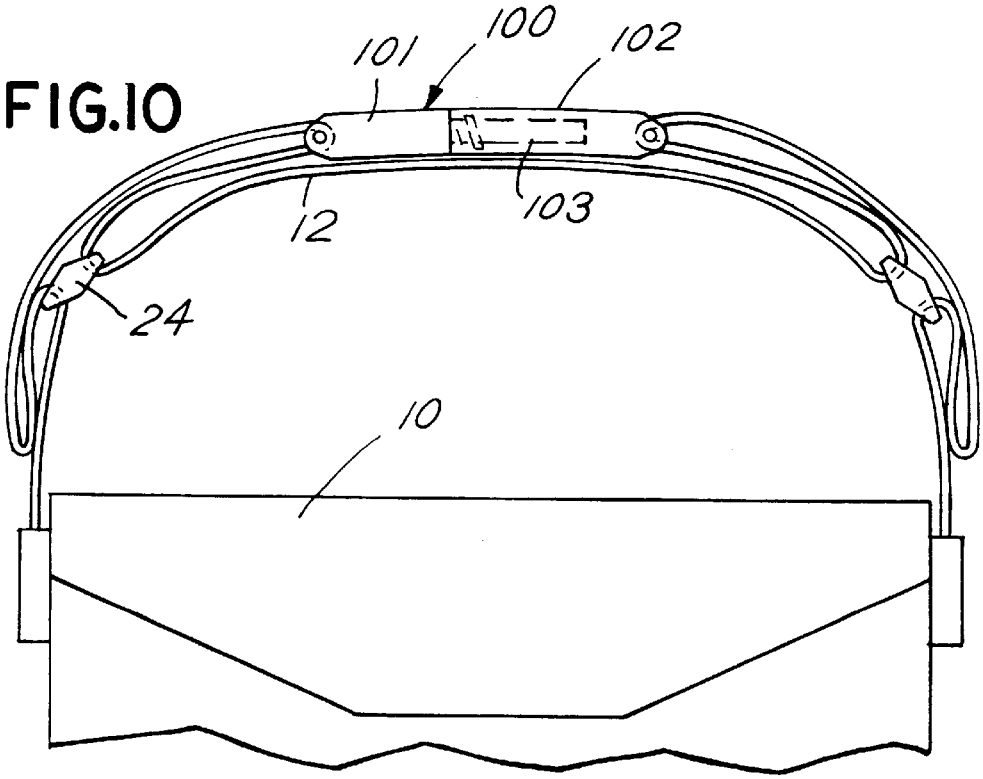
FIG. 10 is a side elevation of yet another alternative construction similar to FIG. 9.

Referring next to FIG. 10, there is illustrated yet another configuration for the buckle element which may be utilized to effect the foreshortening of the strap 12. In FIG. 10, a first buckle element 101 coacts with a second buckle element 102 to define a gripping handle 100. The elements 101 and 102 may be fabricated from a molded plastic material and include a prong or bayonet fitting 103 associated with element 101 that coacts or engages element 102. These elements may be again configured to enhance the comfort of the configuration. The handle 100 is molded so as to permit easy gripping and maneuverability.

FIGS. 11, 12 and 13 depict various loop configurations which may be incorporated or used with the end of strap 12 when configuring the strap 12 in a manner which will coact with ring 24, for example, and attachment of the strap 12 to an item, for example, an item 10. Thus, referring to FIG. 11 there is illustrated a strap 12 which includes a single looped end stitched along a stitch line 110. The positioning of ring 24 and a clip 25 for attachment of the loop to an item 10 is depicted in phantom.

FIG. 12 illustrates an alternative arrangement wherein the looped end of the strap 12 is folded over upon itself and stitched along a stitch line 112 so as to define two openings or loops 114 and 116 which may be associated respectively with a ring 24 for example and a clip 25 to attach the end of the strap 12 to item 10.

FIG. 13 shows yet another arrangement of the folding of the end of strap 12 so that the loops thereby defined will fold upon one another in three layers which are stitched along a line 118 to again define two loops 120 and 122 of a strap 12.

Figure 14:
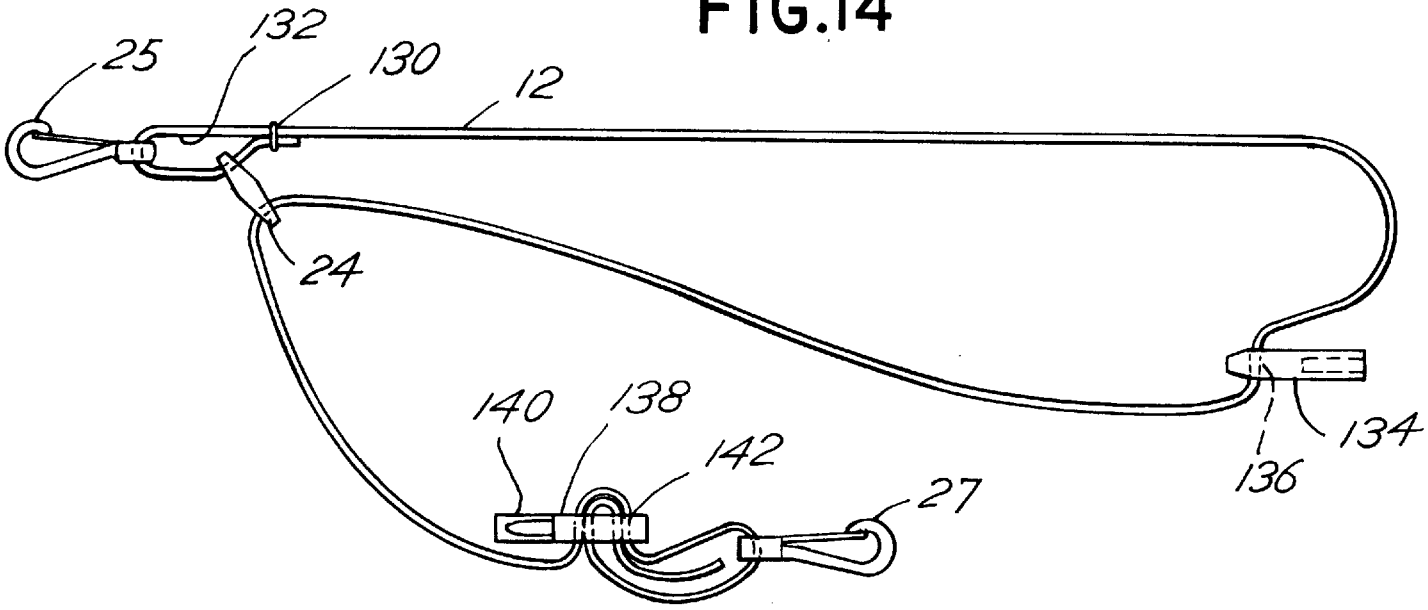
FIG. 14 is a side elevation of a strap configuration utilizing a single stitched loop.
Figure 15:
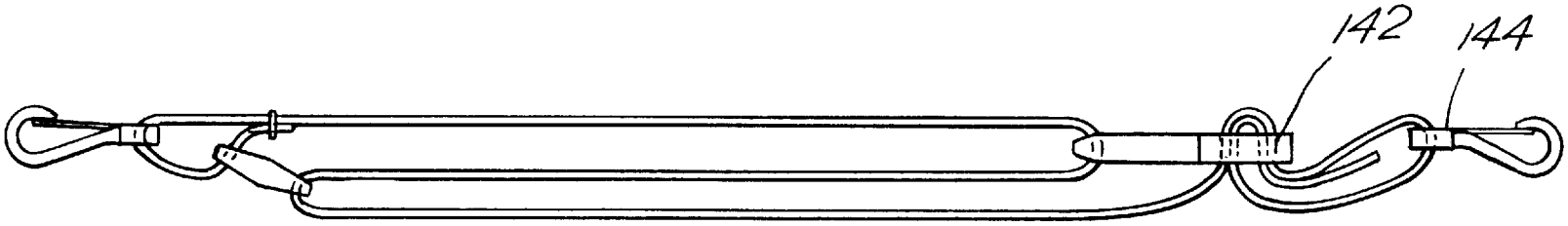
FIG. 15 is another view of the strap construction of FIG. 14.

FIGS. 14 and 15 depict a configuration similar to that disclosed in the prior art U.S. Pat. No. 5,119,910 but wherein the strap 12 is arranged or configured in combination with cooperative elements so that only a single stitch line, tack line, rivet or other assembly method is required in making the assembly. Thus, referring to the figures, the strap 12 is stitched along a single line 130 to form a loop end 132. A fastening clip 25 fits through the loop 132 as does a ring element 24. A buckle element 134 includes a through passage 136 through which the strap may freely move. The strap 12 is looped through the ring element 24 in the manner previously described.

At the opposite end of the strap 12, the strap is folded through a second buckle element 138. The second buckle element 138 includes a fitting 140 which coacts with the first buckle element 134. It also includes a belt buckle type opening or arrangement 142 through which the end of the strap 12 is looped in combination with the fastening element or clip 27. Thus, as shown in FIG. 14 and in FIG. 15, the end of the strap 12 is looped through the belt buckle opening 142, then through a free end passage or loop 144 associated with element 27, then again through the belt buckle loop 142. In this manner, the strap 12 is frictionally held and fixed to the second element 138. No stitching is required at the second end of strap 12 and the construction can thus be assembled during a manufacturing operation with great ease and economy.

Figure 16:
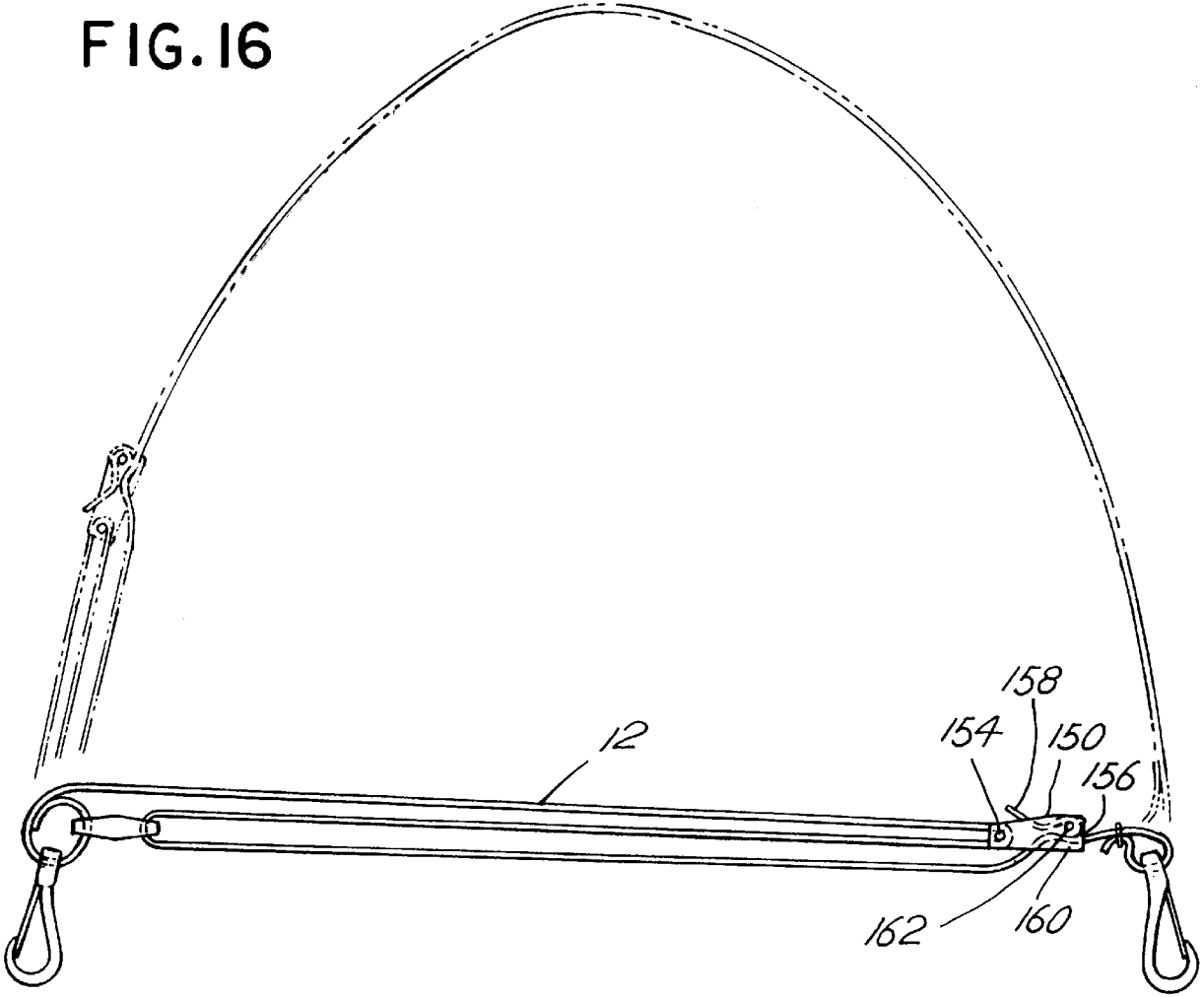
FIG. 16 is an alternative configuration of a strap utilizing a cam release mechanism.

FIG. 16 illustrates yet a further configuration utilizing a cam adjustment ring member 150. As depicted in FIG. 16, the strap 12 fits through a slit or opening and around a rod 154 extending between parallel plates of the ring member 150. A lateral slit or passage is defined through the opposite end of the ring member 150. Thus a passage 156 is defined between a cam member 158 and a rib 160. The cam member 158 pivots about a pin or rod 162. The cam member 158 is designed to frictionally engage the strap 12 and permit infinite adjustment of the strap 12 between the handle position and the elongate position. FIGS. 16 illustrates the manner of adjustment of the length of the strap utilizing the assembly or construction of FIG. 17.

Figure 17:
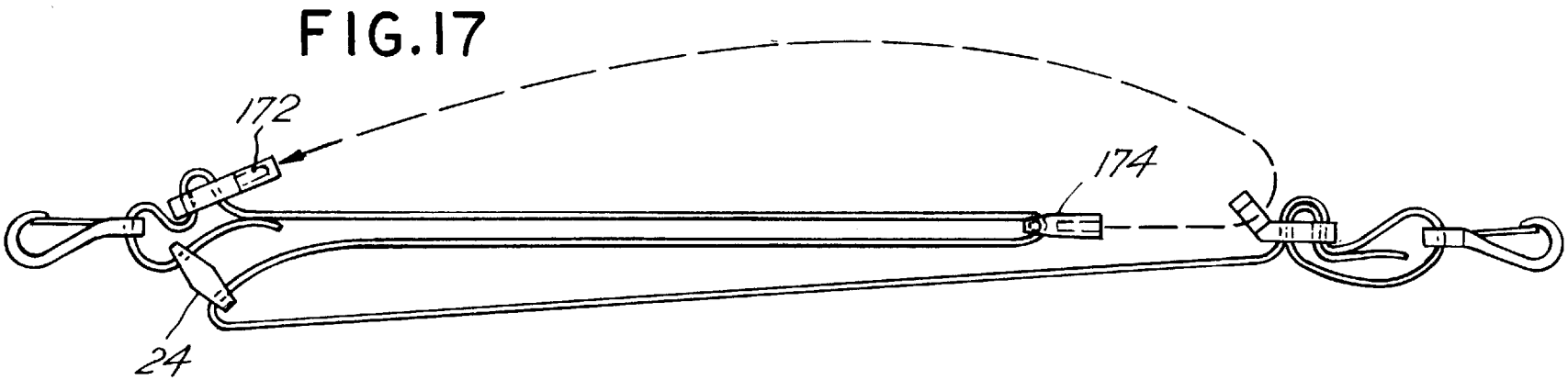
FIG. 17 depicts a strap configuration utilizing a hook member so as to permit five layers of strap in the foreshortened condition.
Figure 19:
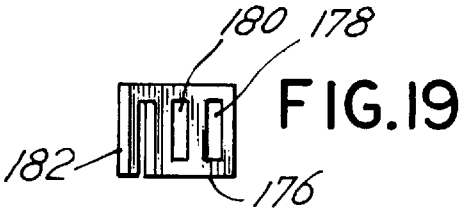
FIG. 19 is a top plan view of the hook mechanism utilized in the configuration of FIGS. 17 and 18.
Figure 18:
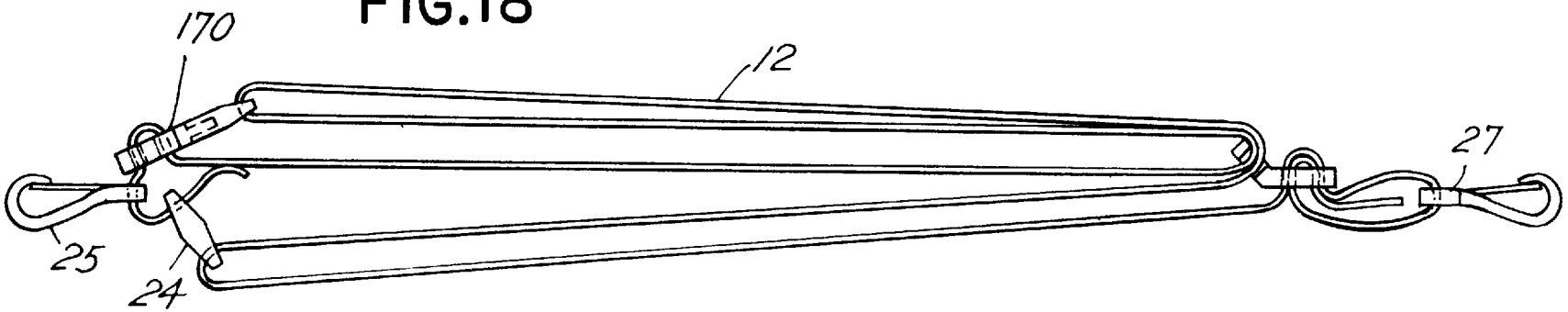
FIG. 18 is another view of the strap configuration of FIG. 17.

FIGS. 17, 18 and 19 illustrate a combination of elements wherein the strap may be additionally foreshortened by utilization of a hook member in combination with the other elements. In this manner, an overlapping of five layers of the strap 12 may be effected to alter the length of the strap between a foreshortened or handle type configuration and an elongate or strap configuration. Thus as depicted in the FIGS. 17, 18 and 19, the strap 12 fits through a ring element 24 as well as a fastening clip mechanism 25. Also, the end of the strap 12 receives a first buckle element 170 which includes a locking member 172 for coaction with a second buckle element 174. The strap 12 fits through the second buckle element 174 in the manner previously described so it is freely moveable through an opening or passage in the strap or buckle element 174. The strap 12 then is fitted through the ring element 24 and then engages through a special hook member 176 as depicted in FIG. 19. The end of the strap 12 thus is threaded through the belt buckle type openings 178 and 180 of the hook member 176 as well as through the opening associated with a fastening element 27.

The hook element 176 includes a hook 182. The strap 12 may thus be foreshortened by fitting the looped strap 12 over the hook 182 as depicted in FIG. 19. Thus, as depicted in FIGS. 17 and 18, the strap 12 may be reduced in length to about 20% of its original full extension.

Figure 20:
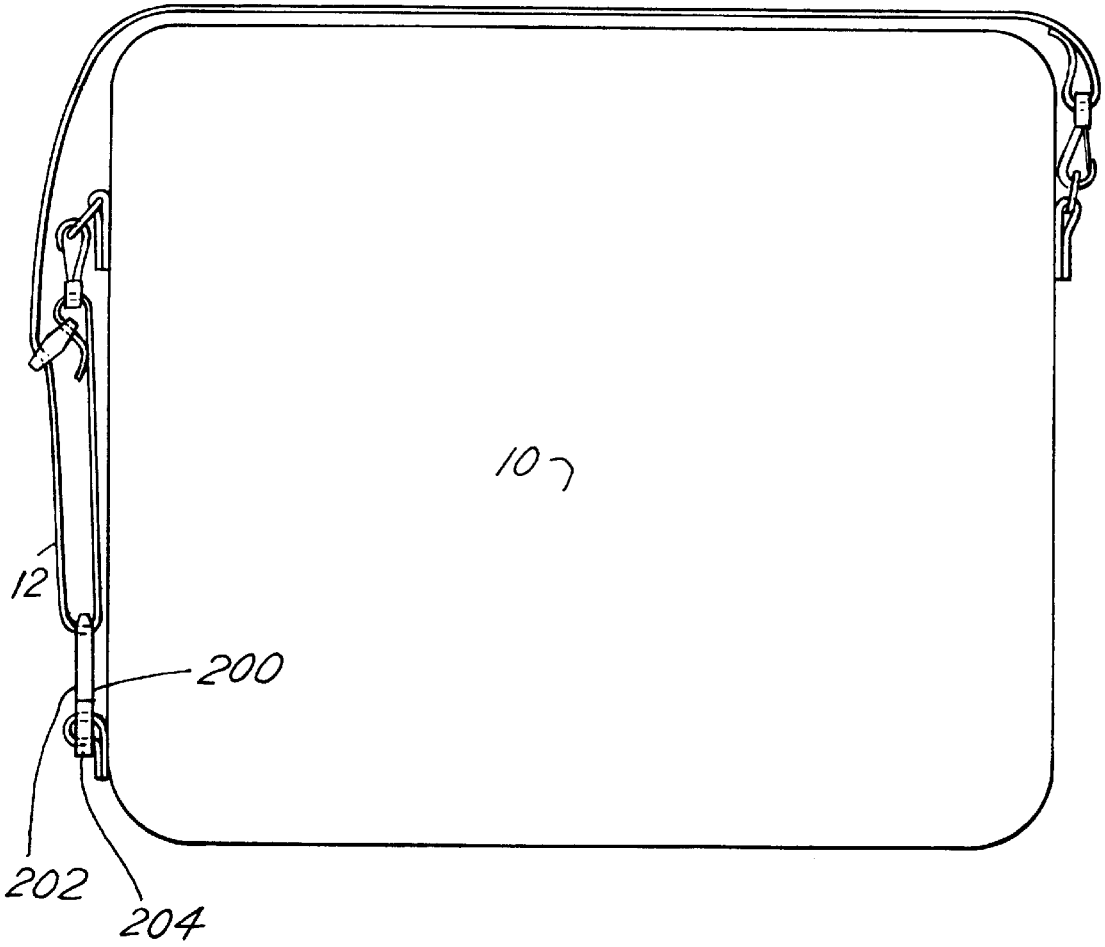
FIG. 20 is a side elevation of a further embodiment of the invention.
Figure 21:
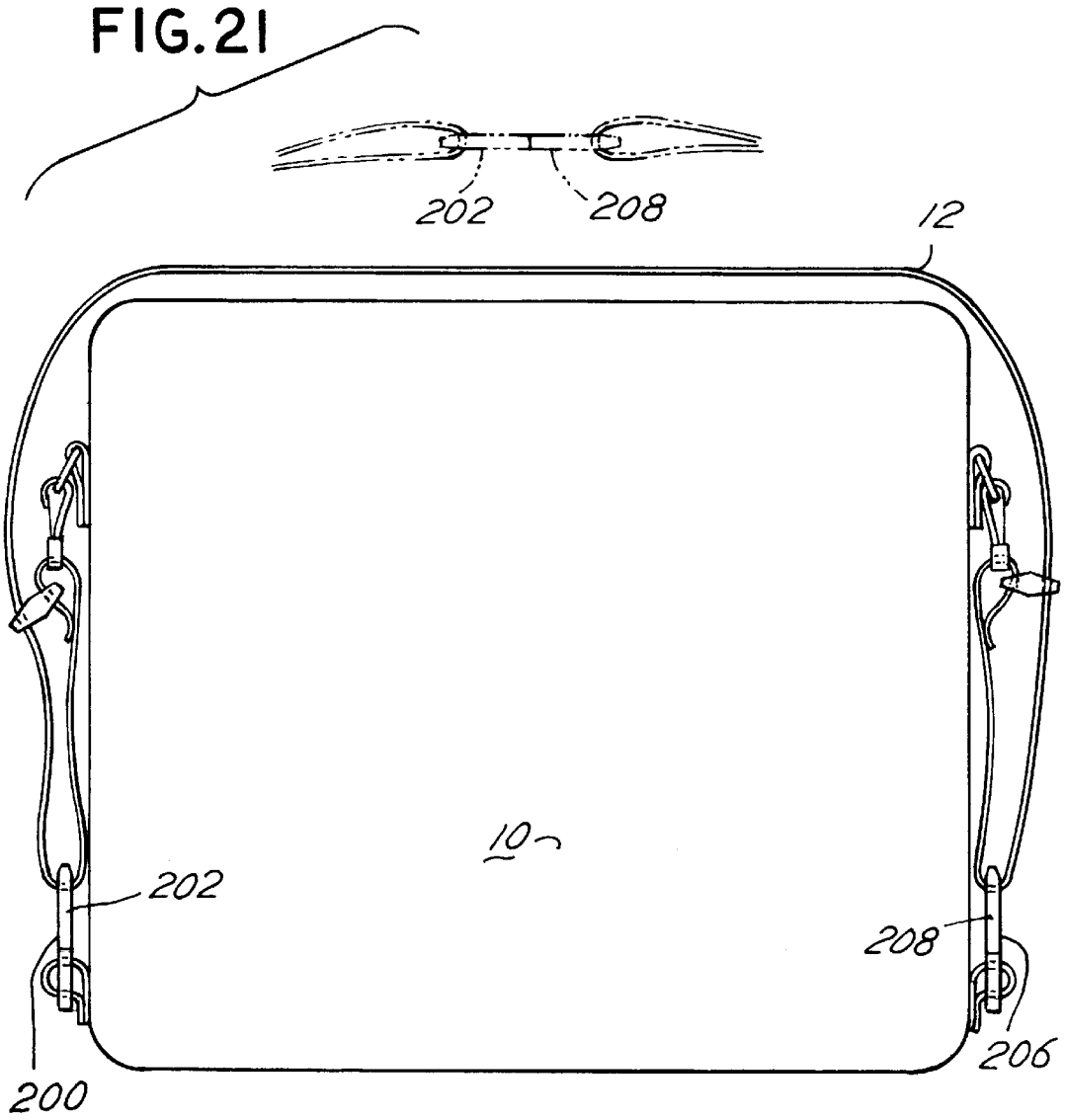
FIG. 21 is a yet another embodiment of the invention similar to an related to the embodiment depicted in FIG. 20.

FIGS. 20 and 21 illustrate yet a further variation of the construction of the invention. Referring to FIG. 20, the buckle 200 includes one element 202 which is slidably affixed to strap 12 and a second element 204 which is affixed to the item 10 which is to be lifted or carried. In the embodiment of FIG. 21, this configuration is further advanced by having a pair of buckles 200 and 206 on opposite sides of the item 10. The strap 12 may thus be foreshortened by engaging the buckle 200 and/or 206. The configuration can be designed so that elements 202 and 208 of the buckles 200 and 206 can be connected to create yet a further intermediate length of the strap. Of course, releasing the buckles 200 and 206 will permit full extension of the strap. As shown in phantom in FIG. 21, the elements 202 and 208 may be connected together. If they are released, then the strap 12 reaches its full elongate length.

Figure 22:
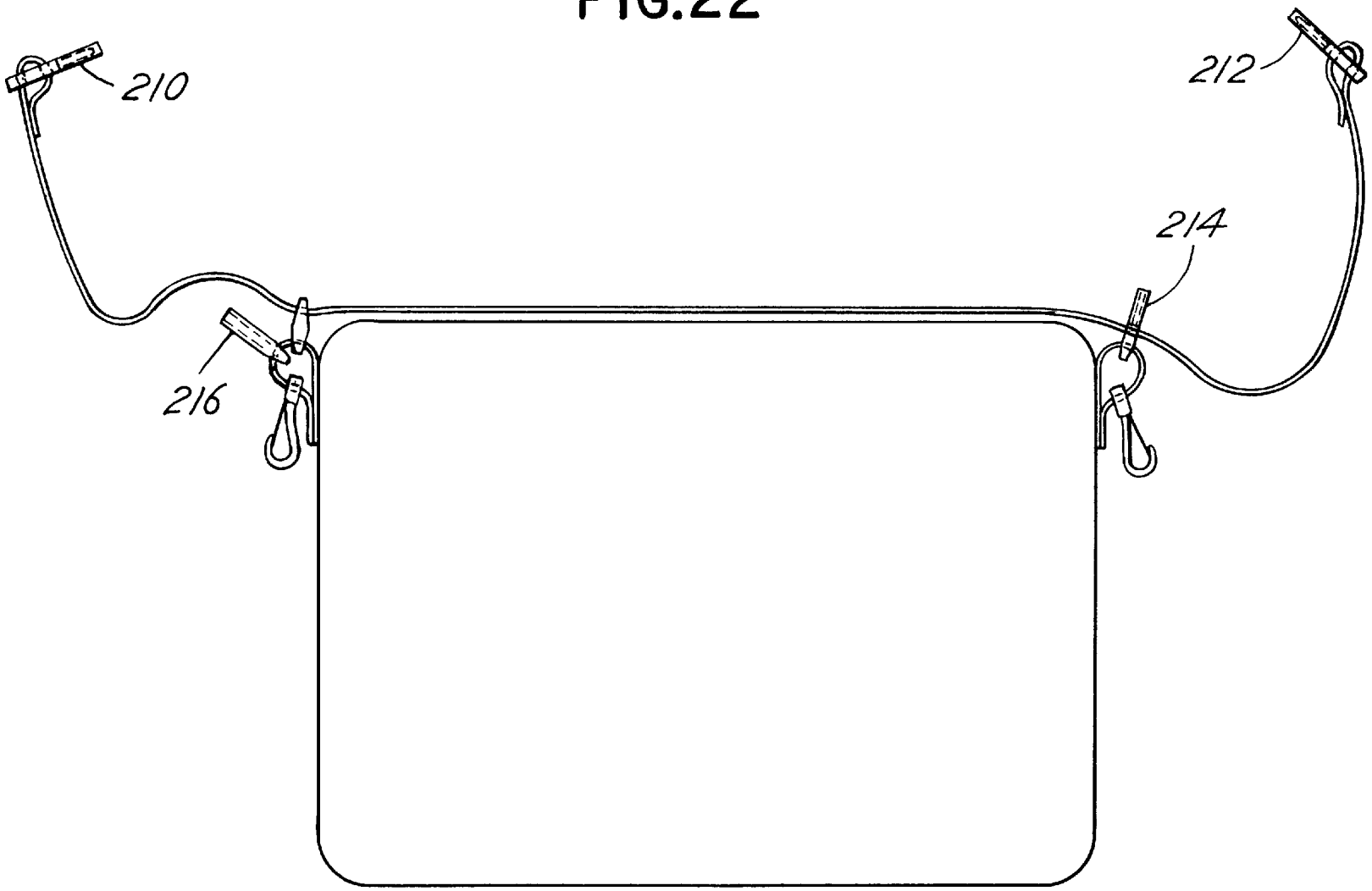
FIG. 22 is yet a further embodiment of the invention.

FIG. 22 illustrates yet another variation. In FIG. 22, a buckle element 210 is designed to coact with a buckle element 212 or an alternative buckle element 214. Similarly, buckle element 212 will cooperate with the buckle element 210 or alternatively with the buckle element 216. In this manner, various alternative lengths of the strap 12 may be effected.

Various permutations and combinations of the described embodiments are possible. The substitution of materials, substitution of various types of rings and buckle elements, utilization of camming mechanisms, lock mechanisms in association with the ring and buckle elements are all variations within the scope of the invention. Utilization of elastic as well as inelastic strap materials is appropriate. Utilization of multiple parallel straps may also be effected. The straps may incorporate designs and various materials. The straps can be used with duffle bags, luggage, valises, suitcases, golf bags, purses, sports bags and almost any item to be carried. The strap may be temporarily or permanently attached to the item. The strap which includes locking buckle elements may be used to lock the bag or item to a post or otherwise. The invention enables a much wider range of adjustment of strap length. Thus, garment bag straps can be placed over the opposite shoulder in the elongate configuration while still maintaining a handle or short configuration capability. Thus, while there has been set forth preferred embodiments of the invention, it is understood the invention is to be limited only by the following claims and their equivalents.

What is claimed is:

1. A strap construction for an item, said strap construction having a strap with a first end and a second end and convertible between a short length comprised of overlying layers of the strap and an elongate length, said strap construction comprising, in combination:

an elongate strap having the first end attached to an item to be supported by the strap, and the second end attached to the item to be supported by the strap, said strap including an intermediate handle section;

a first buckle comprised of first and second engageable buckle elements each including a latching mechanism which couple and decouple with each other, one buckle element also including a loop through which the strap is fitted and slidable, the other element attached to the intermediate handle section;

a second buckle comprised of third and forth engageable buckle elements each including a latching mechanism which couple and decouple with each other, one of said third and forth buckle elements including a loop through which the strap is fitted and slideable, the other of said third and fourth elements attached to the intermediate handle section;

a first connector ring through which the strap is looped and slidable, said first ring positioned between the first buckle element and the second bucklc element, said first ring also being attached to the item adjacent the first end of the strap; and a second connector ring through which the strap is looped and slidable, said second ring positioned between the third buckle element and the fourth buckle element, said second ring also being attached to the item adjacent the second end of the strap, said first and second and said third and fourth buckle elements being coupled respectively to shorten the strap to a short length and decoupled to lengthen the strap to an elongate length by sliding the strap through the rings and buckle element loops and coupling the buckle elements when the strap is shortened, said handle section positioned between the first and second buckles.

2. The strap construction of claim 1 wherein the handle section is split to fit over a handle grip.

3. The strap construction of claim 1 wherein the handle section includes a pad.

* * * * *